US006814010B2

(12) United States Patent
Bart

(10) Patent No.: US 6,814,010 B2
(45) Date of Patent: Nov. 9, 2004

(54) INTERLOCKING KNOCKDOWN FURNITURE WITH UPRIGHT LOCKING PROTRUSIONS

(76) Inventor: Franciscus P. Bart, 408 Prospect Ave., Apt C, Hot Springs, AR (US) 71901

( * ) Notice: Subject to any disclaimer, the term of this patent is extended or adjusted under 35 U.S.C. 154(b) by 0 days.

(21) Appl. No.: 10/645,927

(22) Filed: Aug. 22, 2003

(65) Prior Publication Data

US 2004/0089207 A1 May 13, 2004

Related U.S. Application Data

(62) Division of application No. 09/912,718, filed on Jul. 26, 2001, now Pat. No. 6,615,746.

(51) Int. Cl.[7] ..... A47B 13/02

(52) U.S. Cl. ..... 108/158.12; 108/157.18; 248/165; 248/431

(58) Field of Search ..... 108/158.12, 158.13, 108/157.16, 157.14, 157.18, 180, 183, 186, 187, 190; 248/165, 163.1, 431–432, 188.7

(56) References Cited

U.S. PATENT DOCUMENTS

| | | | |
|---|---|---|---|
| 118,479 | A | 8/1871 | Parker |
| 390,938 | A | 10/1888 | Armstrong |
| 502,778 | A | 8/1893 | Shrague |
| 826,162 | A | 7/1906 | Hedges |
| 874,071 | A | 12/1907 | Holden |
| 919,257 | A | 4/1909 | Seudewitz |
| 1,075,990 | A | 10/1913 | O'Connell |
| 1,832,801 | A | 11/1931 | Wright |
| 1,903,631 | A | 4/1933 | Morrison |
| 1,940,117 | A | 12/1933 | Carpos |
| 2,000,915 | A | 5/1935 | Blake |
| 2,235,290 | A | 3/1941 | Exline et al. |
| 3,263,355 | A | 8/1966 | March |
| 3,338,189 | A | 8/1967 | Xavier |
| 3,501,072 | A | 3/1970 | Kovener |
| 3,698,124 | A | 10/1972 | Reitzel |
| 3,705,556 | A | 12/1972 | Kelly |
| 3,724,399 | A | 4/1973 | Notko |
| 3,940,100 | A | 2/1976 | Haug |
| 4,046,084 | A | 9/1977 | Hosford |
| 4,128,063 | A | 12/1978 | Avery |
| 4,338,867 | A | 7/1982 | Imber |
| 4,351,621 | A | 9/1982 | Liou |
| 4,440,812 | A | 4/1984 | Norrid |
| D304,789 | S | 11/1989 | Scholl |
| 5,992,938 | A | 11/1999 | Jones |
| D424,844 | S | 5/2000 | Gutgsell |
| 6,443,076 | B1 | 9/2002 | Case, Jr. |

FOREIGN PATENT DOCUMENTS

| | | |
|---|---|---|
| DE | 29917673 | * 12/1999 |
| DE | 10026220 | * 12/2001 |

* cited by examiner

*Primary Examiner*—Lanna Mai
*Assistant Examiner*—Hanh V. Tran
(74) *Attorney, Agent, or Firm*—Stephen D. Carver

(57) ABSTRACT

Knockdown furniture including a table with flat, interlocking, planar parts assembled or disassembled without tools or fasteners. Planar legs oriented in radially, spaced apart, mutually abutting relation upon erection, compressively grasp and support an elevated top. Each leg has a foot touching the ground, an integral, upwardly, outwardly diverging arm for grasping the top, a vertically upright protrusion of gradually decreasing width, and a junction region from which these parts emanate. A planar lock includes slots through which the protrusions pass when the furniture is press-fitted together. Lock notches aligned with the slots concurrently engage the arms. Each protrusion decreases in width, with the outside of each protrusion forming a ramp, and the inside forming an elongated, vertical edge. The wedging action resulting from slot-to-ramp engagement locks the legs together, with the complimentary protrusion edges firmly abutting one another and with the top compressively grasped by the arms.

2 Claims, 21 Drawing Sheets

INTERLOCKING KNOCKDOWN FURNITURE WITH UPRIGHT LOCKING PROTRUSIONS

CROSS REFERENCE TO RELATED APPLICATION

This application is a divisional application based upon my prior pending application Ser. No. 09/912,718, filed Jul. 26, 2001 now U.S. Pat. No. 6,615,746 by applicant, Franciscus P. Bart, and entitled "Jointed Interlocking Knock-Down Furniture."

BACKGROUND OF THE INVENTION

I. Field of the Invention

The present invention relates generally to modular furniture items. More particularly, my invention relates to portable, knockdown furniture items comprising a plurality of flat, readily transportable parts that can be easily erected or disassembled without special tools.

II. Description of the Prior Art

The prior art recognizes that modular, knockdown furniture items have a variety of useful applications. One advantage of modular construction is that the device parts may be shipped in a flat configuration in disassembled form. The user can then simply fit the parts together to create a piece of furniture. With a variety of parts of different shapes and sizes, the user can create different artistic effects as well as different furniture forms. Once at the application site, the parts should fit together reliably and easily to facilitate erection.

Furniture articles that can be folded or disassembled into individual, flat constituent parts can more easily be stored and transported. When unassembled and piled together, flat parts will occupy a minimum amount of storage space. Hunters, campers, and other outdoor users, for example, prefer knockdown items, as they can easily be stored, hauled to the campsite, and erected for use in a short period of time. The user can easily put the items together, as long as simplicity of design is maintained, and especially where the design omits irregular or complex parts. Favorable designs should comprise parts that may be quickly and easily assembled without the use of hand tools. The requirement of special tools is especially disadvantageous. Furniture items comprising a minimum of parts that fit together reliably without the necessity to read or study manuals or other documentation are preferred.

One problem with modular furniture is that sturdy, assembled structures are difficult to erect with parts that are easily assembled and disassembled. Some prior art knockdown articles have recognizable disadvantages. Some devices comprise too many parts, and sometimes tools or special fasteners are required for erection. Some knockdown devices comprise intricate parts that are too expensive. Some folding furniture devices require assembly by relatively skilled personnel. Some knockdown articles cannot withstand heavy use, and they will not reliably support heavy loads. Known devices that do not require fasteners and/or hand tools for assembly or disassembly lack the mechanical durability and dependability required for commercial success.

The most reliable and durable prior art knockdown furniture items have all required tools or multiple fasteners. An easily assembled knockdown arrangement that consists only of flat pieces, and which can be hand-assembled into a durable and powerful furniture article would be highly desirable.

SUMMARY OF THE INVENTION

All embodiments of my knockdown furniture comprise a plurality of flat, planar parts that can be easily erected without hand tools or fasteners. The assembled items are easily disassembled, and the lightweight, flat parts can be quickly separated and stored for transportation.

Each furniture item comprises a plurality of identical, generally C-shaped legs, a relatively large, flat top supported by the legs, and a planar lock in the form of an intermediate surface disposed by the legs below the top. The top may be circular, or it may be in the form of a regular polygon. The lock may be shaped similarly, but preferably, it is smaller than the top. Each leg is generally C-shaped, comprising a foot for touching the ground or floor, an upper arm for grasping the top, and an intermediate section that is oriented generally perpendicularly relative to the ground when assembly is completed.

Special slots are defined in the lock for receiving the legs, which are first rotated during assembly until the legs are vertical, with their midsections confined and captivated within the lock slots. Importantly, each leg intermediate section varies in width. The outside of the leg intermediate region comprises a ramp. The inside of the same area forms a complementary leg edge. The distance between the ramp's structure and the complementary edges varies, to enable a wedging action in response to the lock. The legs assume a position in assembly wherein they are radially spaced apart, with the inner, complementary leg edges of each leg midsection abutting one another. At the same time, the leg's ramps contact the outermost ends of the lock slots, in which the legs are inserted and confined. Once the legs are installed, the lock can be pressed downwardly to firmly, compressively secure the legs and the rest of the parts together. The leg arms have hooks that firmly grasp the top in assembly.

This invention provides a knock down furniture design comprising a plurality of flat, planar parts that can be fitted together without tools or fasteners. Once assembled, the device functions durably and dependably until disassembled as desired.

Thus, a basic object of my invention is to provide a knockdown furniture item comprised only of flat, interfitting parts that can be assembled without tools or fasteners.

Another basic object is to provide a robust furniture item that can be easily stored and transported.

A fundamental object is to provide a furniture item of the character described that can be user-erected without tools.

Similarly, it is a broad object of my invention to provide a knockdown furniture item comprising a minimal number of parts.

Yet another important object is to provide a furniture item of the character described that can be deployed in the form of a table, chair or other desired furniture article.

Another object is to provide a stool, table or similar furniture article that can be stored in a completely flat orientation.

A similar object is to minimize storage and transportation volume requirements.

Another important object is to provide a similar furniture article of the character described which is lightweight and sturdy.

A still further object is to provide a modular knockdown furniture item such as a table or chair whose components can be sold in an easily assembled kit form.

Yet, another broad object is to provide an article of furniture comprising generally planar parts that are made of sheet or board material.

Another important object is to enable the user to quickly erect a durable and sturdy furniture article without special training.

A similar object is to enable the user to quickly erect a sturdy and durable furniture item without the need for referencing complex manuals or instructions.

A fundamental object is to provide a modular, knockdown furniture construction of the character described comprised of parts that may be manufactured from plastic, corrugated material, cardboard, plywood or the like.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
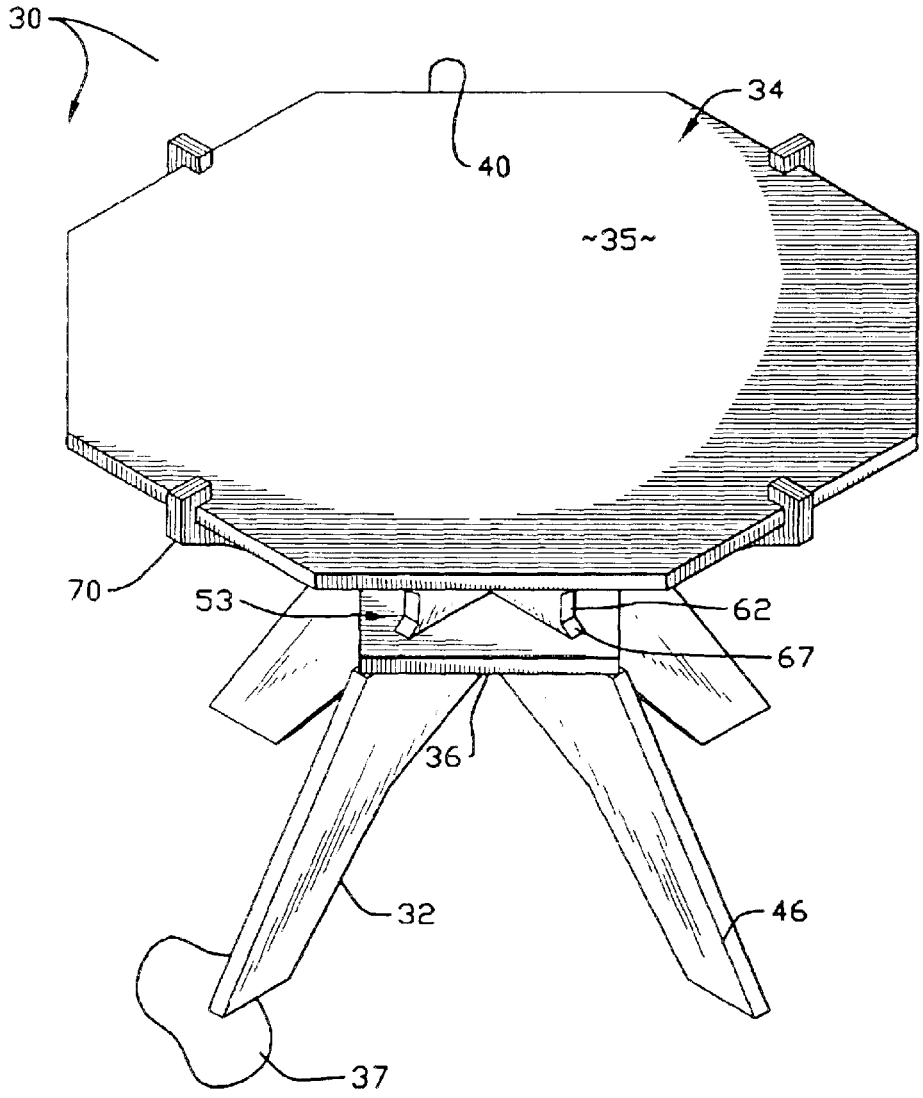
FIG. 1 is a frontal isometric perspective view of a preferred embodiment of my invention, comprising a knockdown table with an octagonal top.
Figure 2:
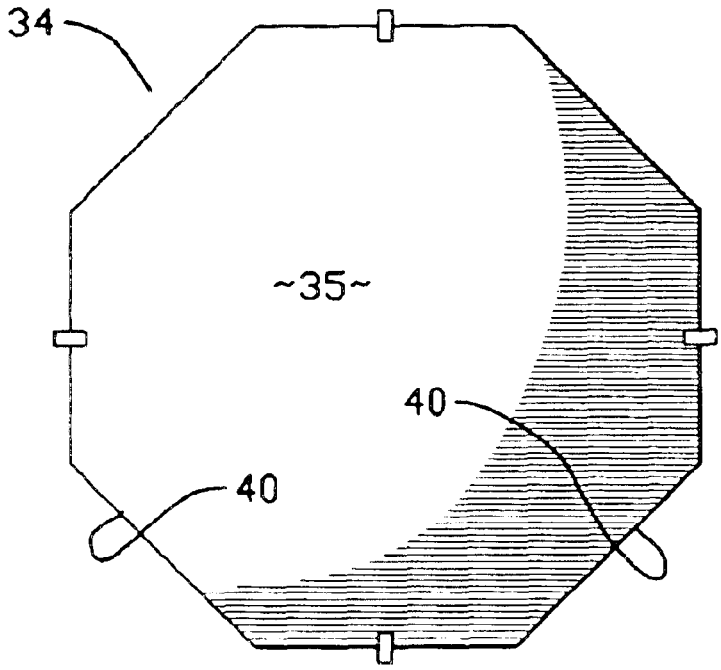
FIG. 2 is a top plan view thereof.
Figure 3:
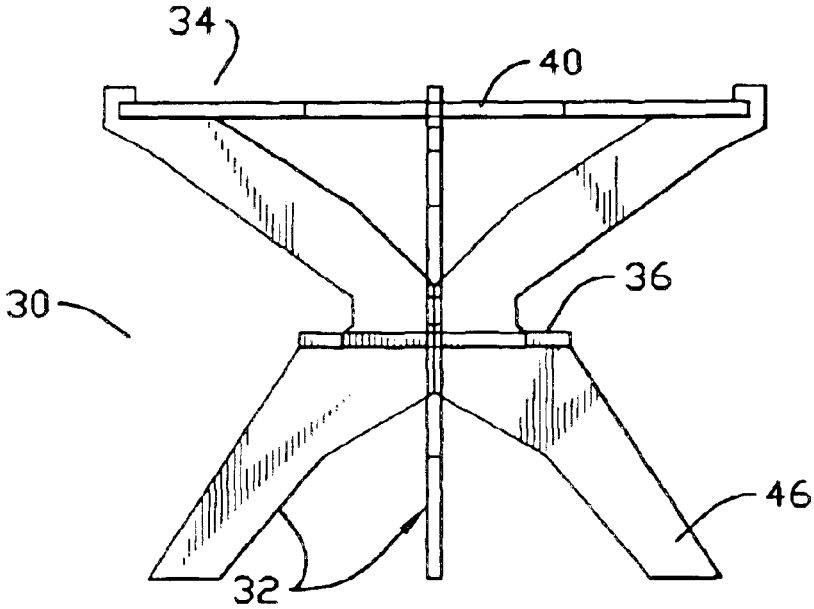
FIG. 3 is a front plan view thereof.

Turning initially now to FIGS. 1–12 of the drawings, an alternative embodiment of my knockdown furniture invention comprises a table, generally designated by the reference numeral 30. The preferred embodiment is seen in FIGS. 22–26. Table 30 comprises a plurality of planar parts to be described later, that can all be made from planar material such as cardboard, fiber board, corrugated plywood or the like. The parts may be assembled or disassembled, as described later, without hand tools, and when assembled, a rigid and dependable furniture item is created. No special fasteners are required.

Figure 9:
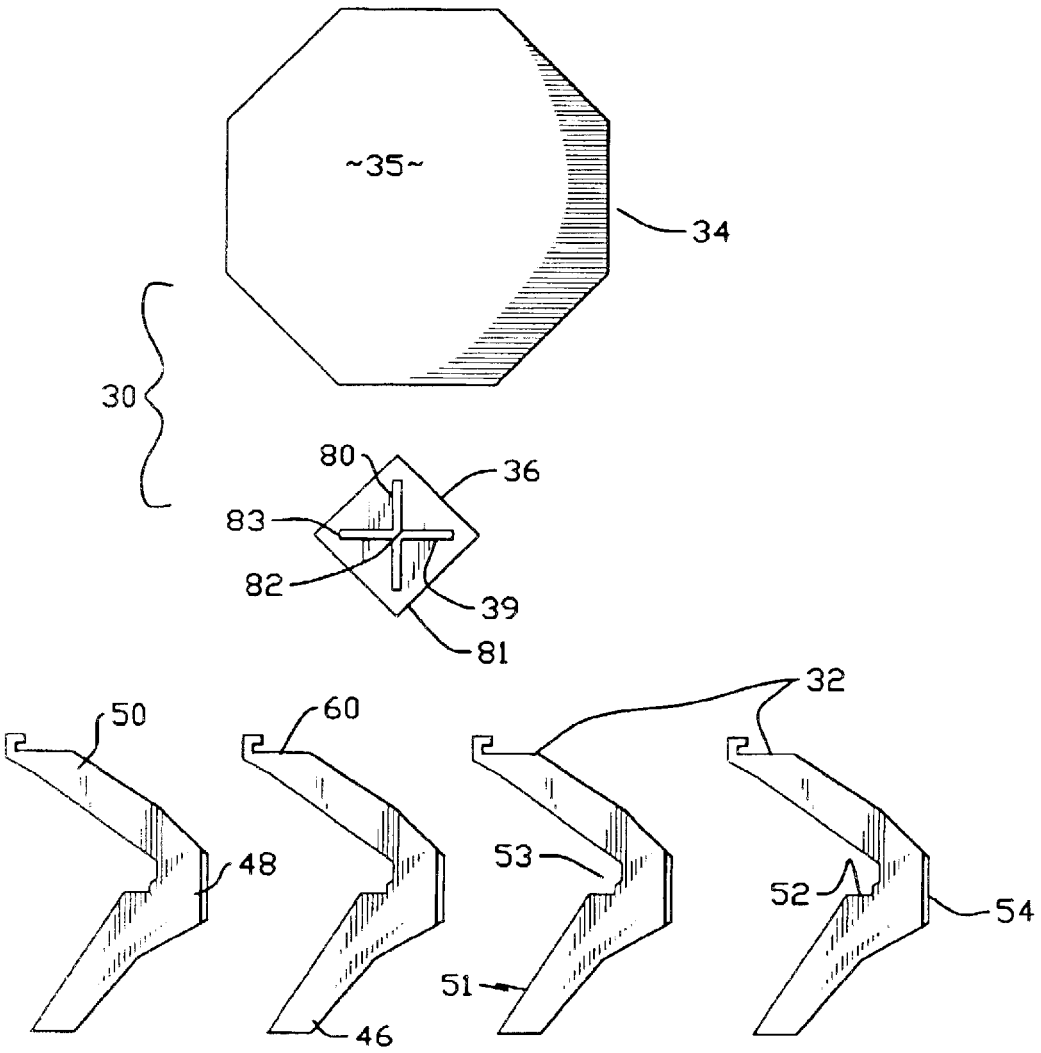
FIG. 9 is an exploded plan view of the individual, unassembled parts of the first embodiment conveniently, flatly disposed in a position for transportation or assembly.

Table 30 comprises the three main components laid out for convenient viewing in FIG. 9. These are legs, generally designated by the reference numeral 32, a planar, generally polygonal top, broadly designated by the reference numeral 34, and an intermediate, planar lock, generally designated by the reference numeral 36. When the foregoing parts are assembled, as described in further detail hereinafter, the legs are inserted through the slot structure 39 (FIG. 4) defined in the lock 36, and they reach upwardly and engage and support top 34. Once they are inserted and properly juxtapositioned by the assembler, the lock 36 is pressed downwardly to secure the legs in radially spaced-apart orientation, firmly grasping the top and reinforcing the leg structure. As hereinafter further described, the furniture item (i.e., table 30) results. It is adapted to be deployed upon a firm, planar, supporting surface such as floor 37 (FIG. 1). When assembled, the table legs 32 are firmly pressed against one another in an edgewise fashion, with the tabletop 34 disposed vertically above the lock 36. When properly deployed, lock 36 will be parallel with top 34. The exposed, upper supporting surface 35 of table top 34 presents a strong and durable support for a variety of items, including picnic supplies, silverware, plates, pots and pans and the like.

In table embodiment 30, the top 34 is preferably octagonal, comprising eight symmetrical edges 40 (FIG. 2) that are radially spaced apart about the center of table surface 35. This configuration is but one of many that may be adopted. For example, the top 34 may be round, triangular, hexagonal, or square. It may assume the shape of any regular polygon. Where legs of varying configurations are allowed, then the top may assume a rectangular shape, or even irregular shapes, resembling trapezoids, truncated cones, semicircles and/or the like. Preferably, the legs form a symmetrical array, placed radially about the structure. Preferably, there are a number of legs 32 at least equal to three, and preferably equal to an integer fraction of the number of topsides. For example, where an octagonal top 34 is chosen, eight-table sides result, and eight divided by the integer two yields four legs. As will become apparent hereinafter, the number of legs could equal the number of tabletop sides, particularly with a square top. Preferably, the design contemplates one leg 32 for each two tabletop sides.

Figure 4:
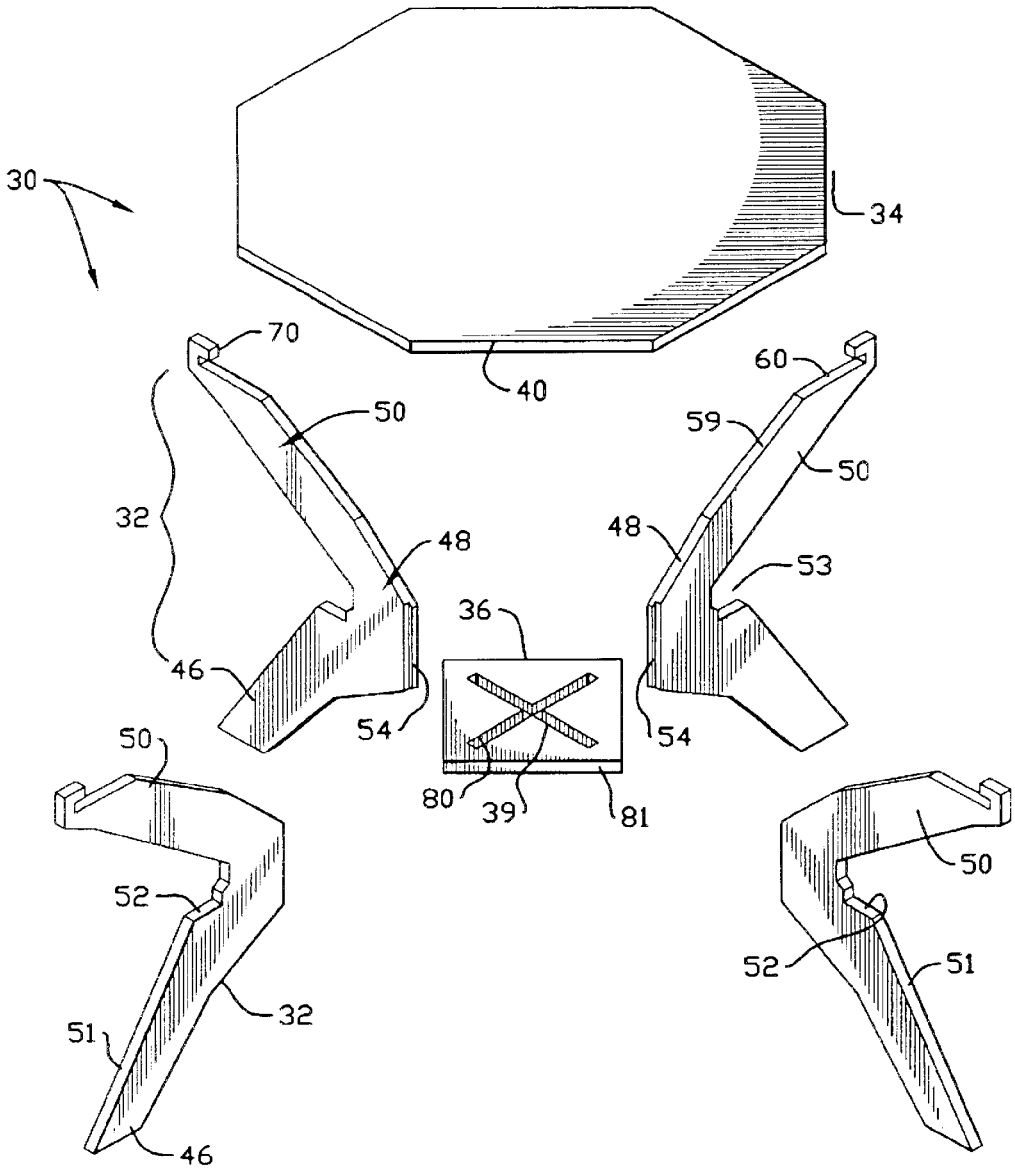
FIG. 4 is an exploded isometric view thereof.

The preferred legs 32 are all planar (i.e., for example, each leg is identical), and preferably, in a typical package of components, sold as a kit. With primary reference directed to FIGS. 4, 5, 9, and 10, the legs comprise a bottom foot 46, an upper arm 50, and an integral midsection 48. Each foot 46 comprises a terminal bottom edge 49 (FIG. 5) adapted to be disposed upon a supporting surface 37 (FIG. 1) when the assembly is constructed. Foot 46 upwardly transitions to midsection 48 (FIG. 4). The outer edge 51 (FIG. 4) of each foot meets the supporting ledge 52 (FIGS. 4, 5) formed on the outside of midsection 48. A step-like, stair-shaped wedging region 53 is formed on the outside of the legs, spaced apart from the specially configured, complimentary inner edges 54 (FIG. 9) of each midsection 48. Importantly, the width of the leg across the intermediate portions 48 varies. In other words, the distance between the inner edge 54 and the opposite, outer wedging region 53 preferably increases as one moves downwardly. As explained later, this facilitates a locking action as the lock is pressed into position.

Figure 5:
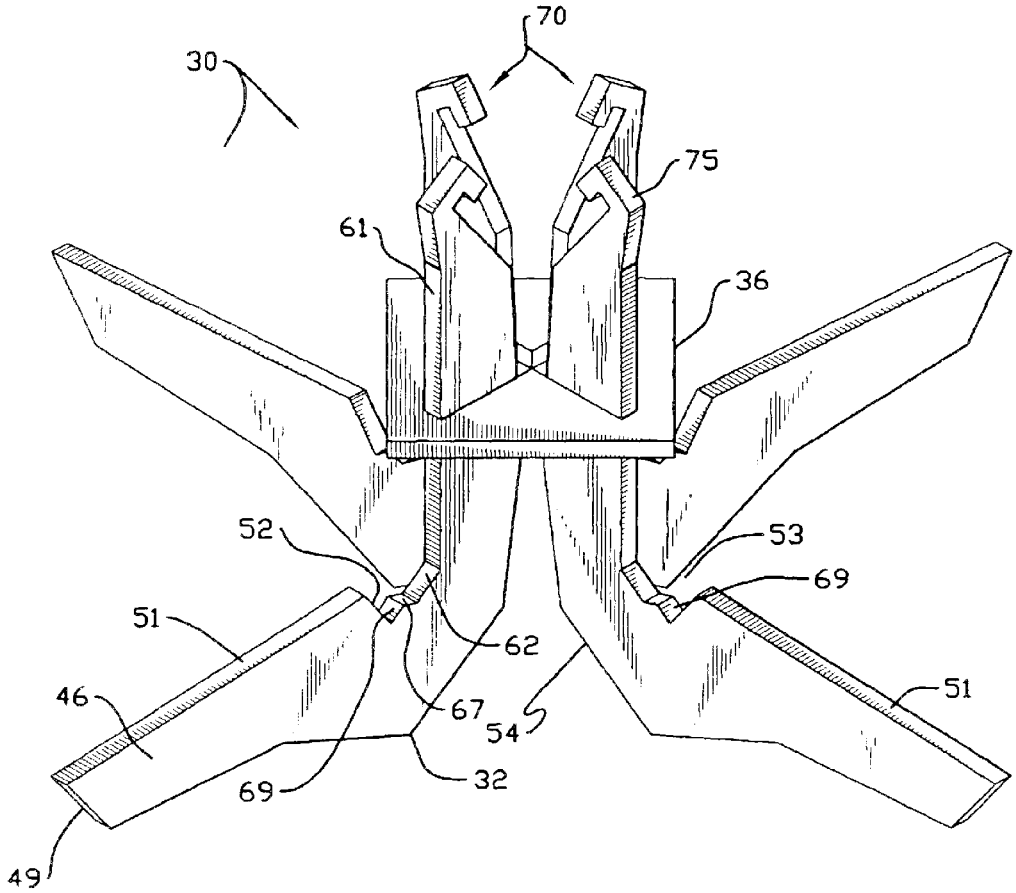
FIG. 5 is a frontal isometric view of a partially erected assembly.
Figure 7:
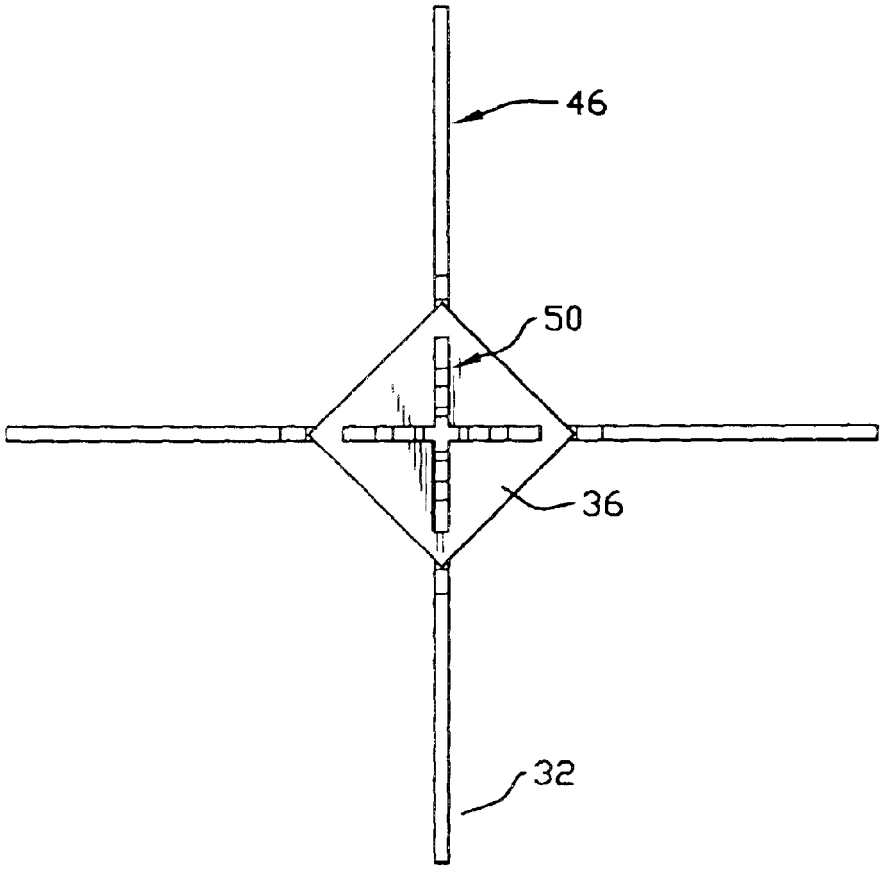
FIG. 7 is a top plan view of the assembly of FIG. 6.
Figure 10:
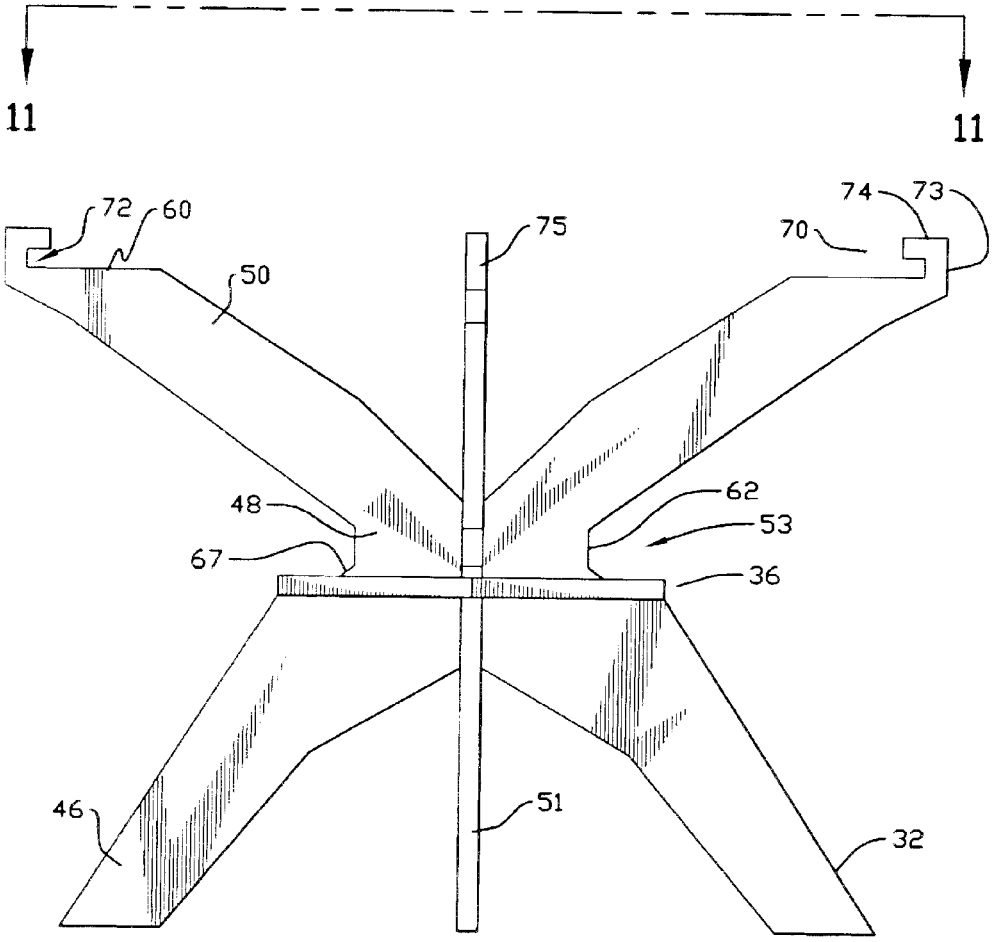
FIG. 10 is an enlarged, front plan view of the preferred embodiment, showing it partially assembled/disassembled.

Each arm 50 integrally extends angularly, upwardly and outwardly from midsection 48 (i.e., FIG. 10). The inner, upper arm edges 58 and 59, and upper, supporting ledge 60 (FIG. 8) transition away from special edge 54 of the midsection 48. The lower, outer edge 61 of the arms is substantially straight. As best seen in FIG. 5, the midsection's wedging region 53 comprises an angled edge 62 (FIG. 5) that adjoins arm upper edge 61 and raised, projecting region 53 (FIG. 5). Region 53 comprises a first ramp 67 (FIG. 8) and a second ramp 69 (FIG. 5). Ramp 67 adjoins angled midsection edge 62. Ramp 69 adjoins ramp 67 and ledge 52 (FIG. 5). Region 53 effectively causes the width across the leg midsection to vary, i.e., the width between edges 54 and 62 is less than the width between edge 54 and ramps 67 or 69. The lock wedges the parts together as it is pressed downwardly, with the leg midsection captivated within the lock slots described later. In other words, in assembly, the legs are juxtapositioned between the orientations of FIGS. 5 and 10; FIG. 5 shows the lock partly installed upon the loose legs and FIG. 10 shows the firm leg alignment maintained by the lock after it has been pressed into place.

The upper arm 50 of each leg 32 terminates in a generally C-shaped hook 70 (FIGS. 5, 8, 10) that projects from exposed ledge 60 of the arm. When assembled, the arm ledge 60 will support the tabletop 34 previously described, as the various table edges 40 can be fitted within channels 72 (FIGS. 8, 10) so the arms support the tabletop. The upper ledges 60 of each leg are parallel with ledges 52 (FIG. 4) that support the lock 36. Hook 70 comprises an inwardly projecting channel 72 that receives edges of the tabletop upon assembly. The channel 72 results from the generally C-shaped terminus 73 at the top of each leg's upper arms 50. Channels 72 (FIG. 8) will be arranged symmetrically, in a radially spaced apart configuration conforming to the placement of the legs upon assembly. Upon proper assembly, the exposed upper surface 74 (FIGS. 8, 10, 11) of each terminus will be oriented parallel with ledges 52 and 60 previously described, with adjoining vertical surface 75 (FIG. 10) oriented perpendicularly.

The lock 36 is best addressed with concurrent reference to FIGS. 4, 9, 11, and 12. It will be observed that the generally planar lock is flat and square. Its shape is not as important as the fact that it contains an internal, central slot structure 39, which is symmetrical. With four legs, it is preferably in the form of a cross, with one individual slot to receive each leg. In this embodiment, four individual radially spaced apart slots 80 (FIG. 4) are defined in the lock 36. The lock 36 has a plurality of symmetrical sides 81 (FIG. 9) forming, in this instance, a square shape. The shape can be different, as apparent to those with skill in the art. The number of slots preferably equals the number of legs to be used. In the best mode of this embodiment, the four, individual radially spaced-apart slots 80 meet at the center 82 of the lock, and the outermost slot ends project towards the lock corners. The slots are dimensioned carefully to frictionally and firmly receive and lock the legs. The distance from a slot end 83 to the slot center 82 (FIG. 9) roughly approximates the width of the leg midsection or wedging region as measured between inner edge 54 (i.e., FIGS. 4, 5, 9) and the ramps 67, 69 (FIGS. 5, 10).

Figure 11:
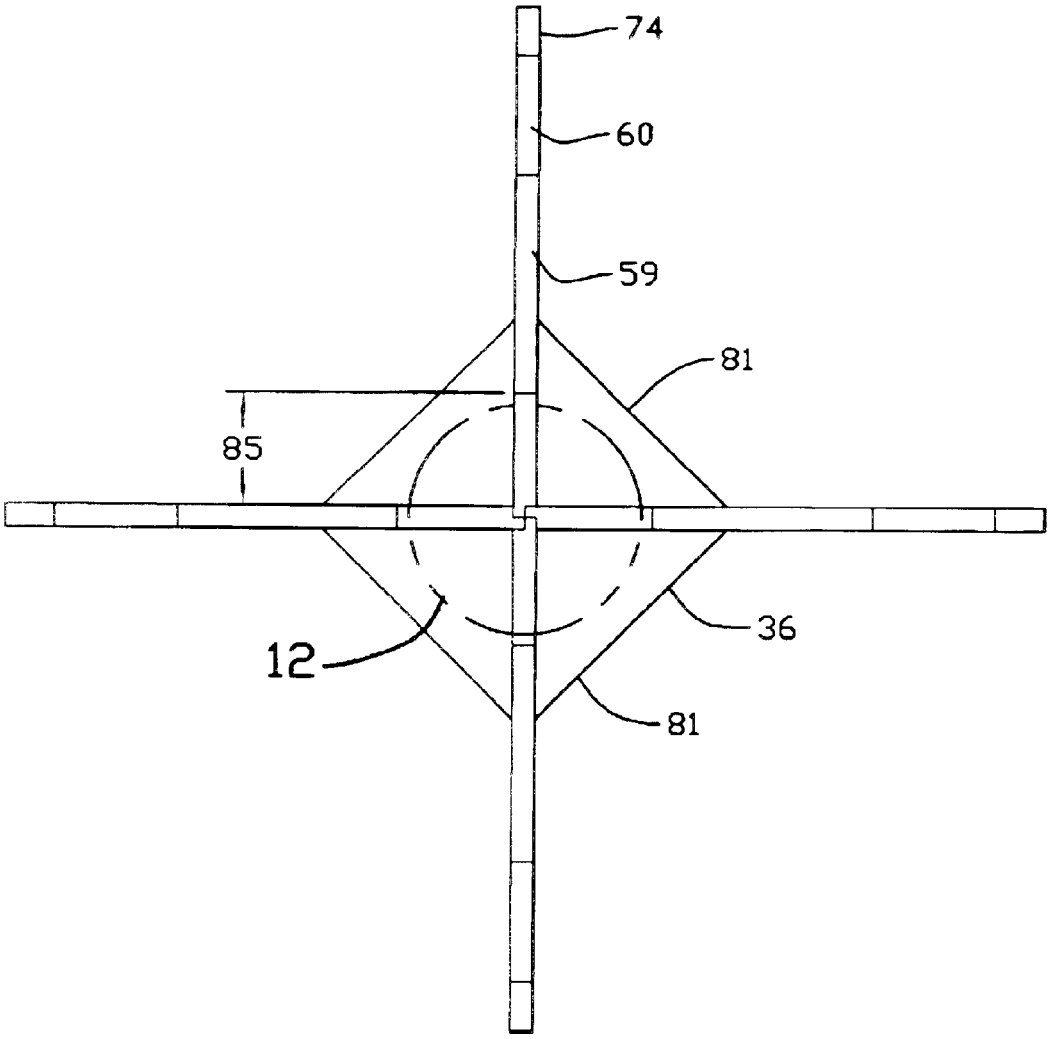
FIG. 11 is a top plan view of the preferred embodiment taken generally along lines 11—11 in FIG. 10.
Figure 12:
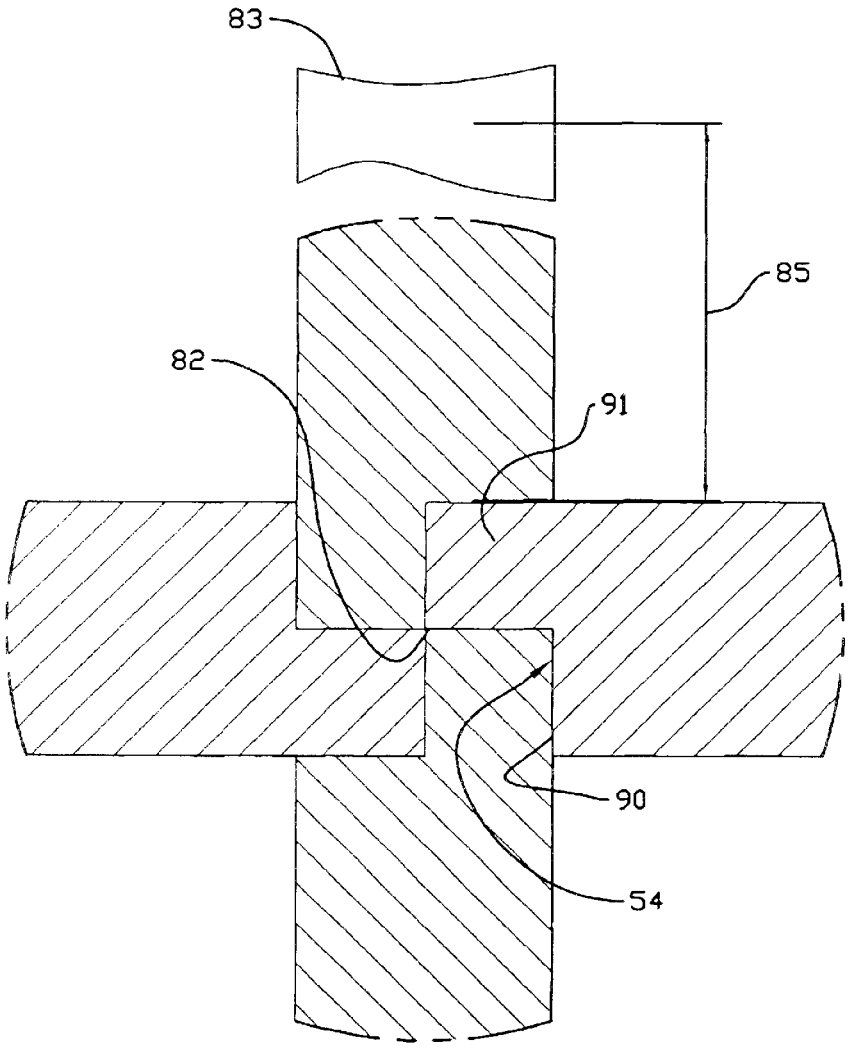
FIG. 12 is an enlarged, fragmentary sectional view of the preferred embodiment based generally upon circled region 12 of FIG. 11.
Figure 13:
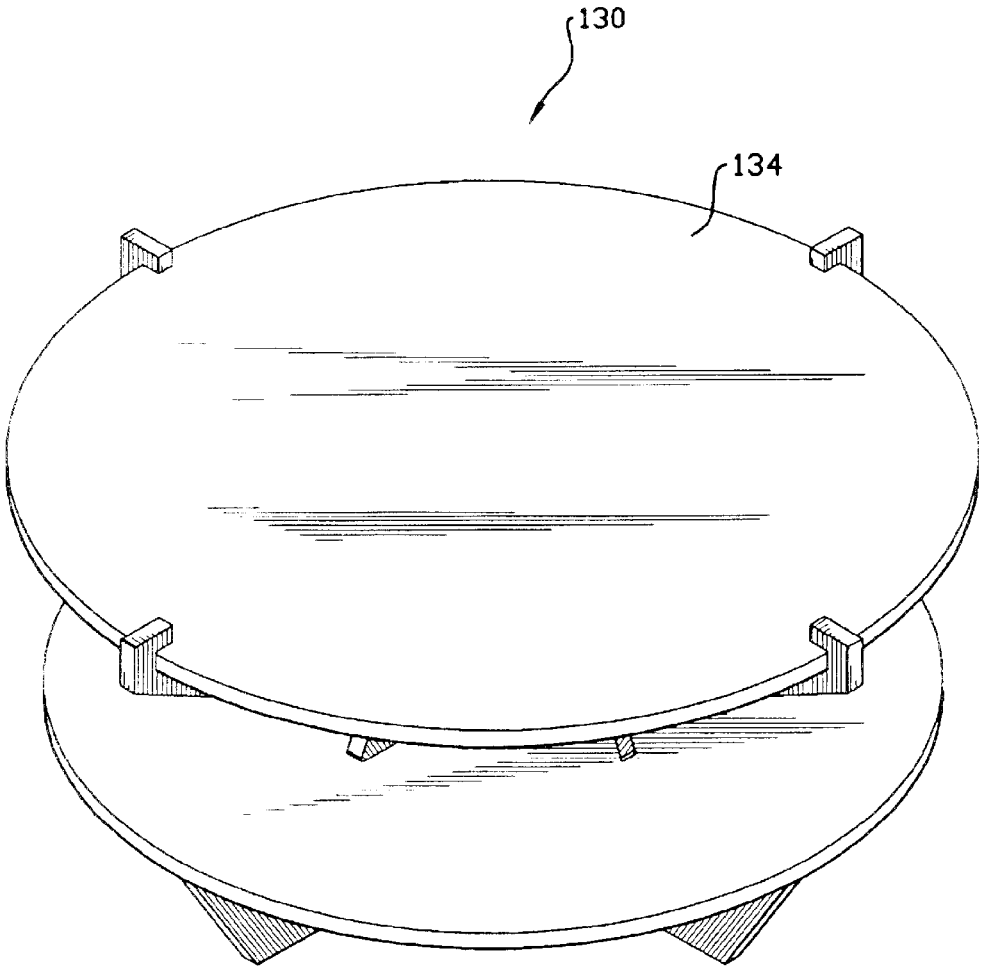
FIG. 13 is a frontal isometric view of a second or alternative embodiment of my invention, comprising a knockdown chair or stool with a round top.
Figure 15:
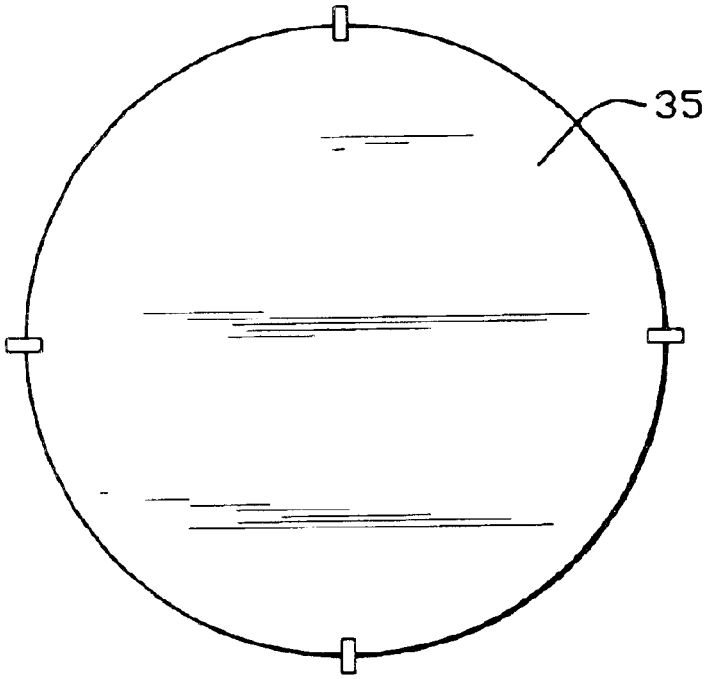
FIG. 15 is a top plan view of the alternative embodiment.
Figure 14:
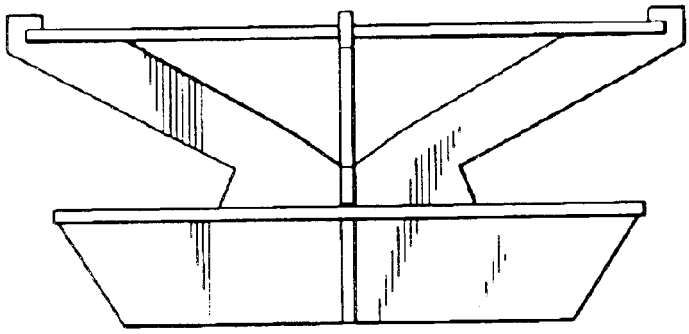
FIG. 14 is a front plan view of the alternative embodiment.
Figure 16:
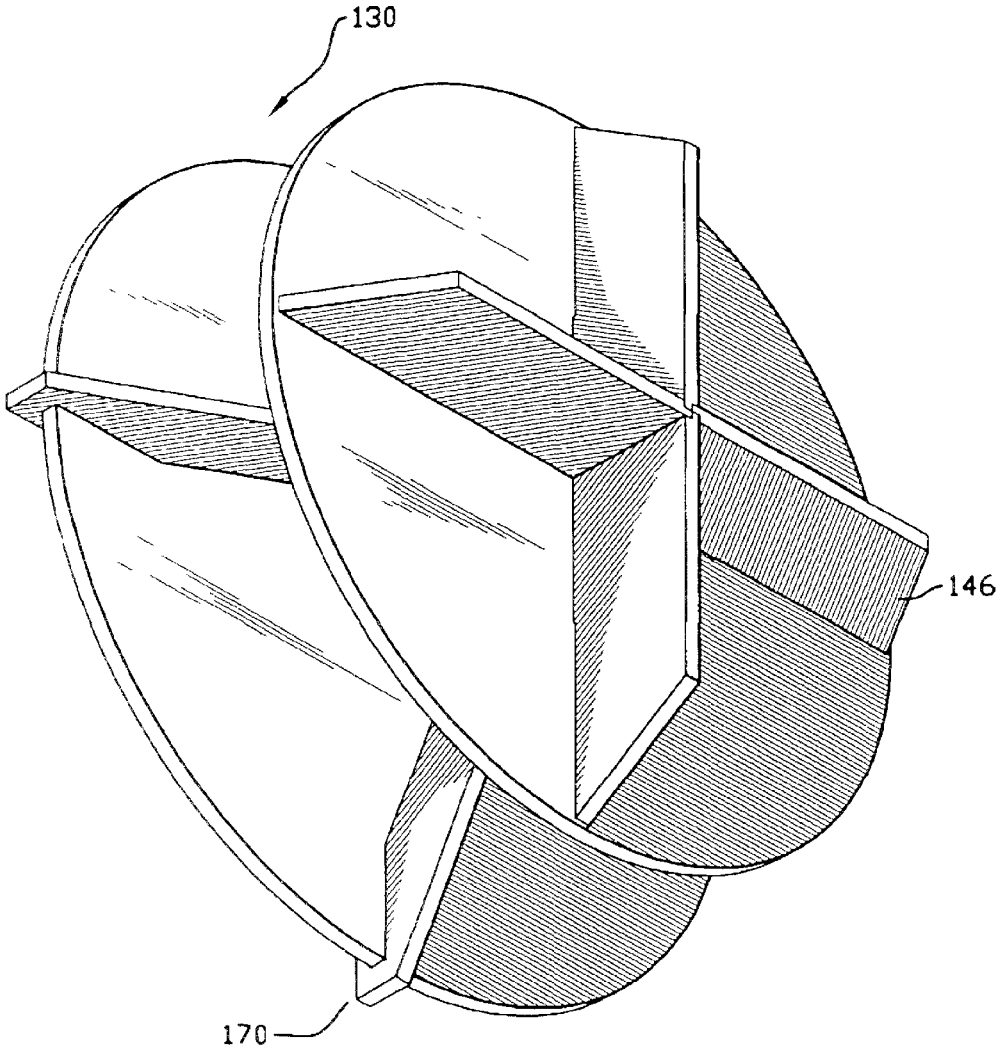
FIG. 16 is a bottom isometric view of the alternative embodiment.
Figure 18:
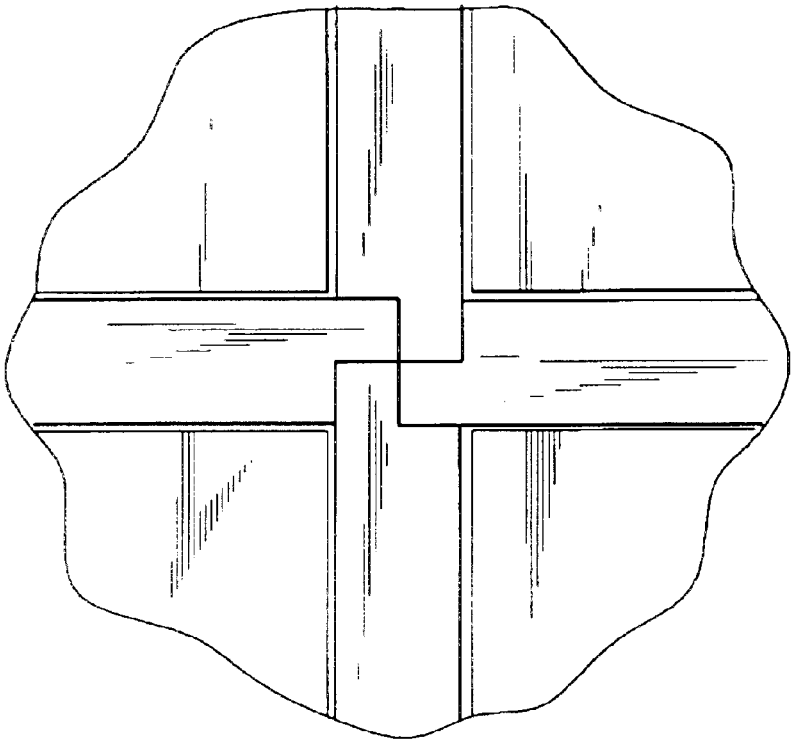
FIG. 18 is an enlarged, fragmentary sectional view taken generally along line 18—18 of FIG. 17.
Figure 17:
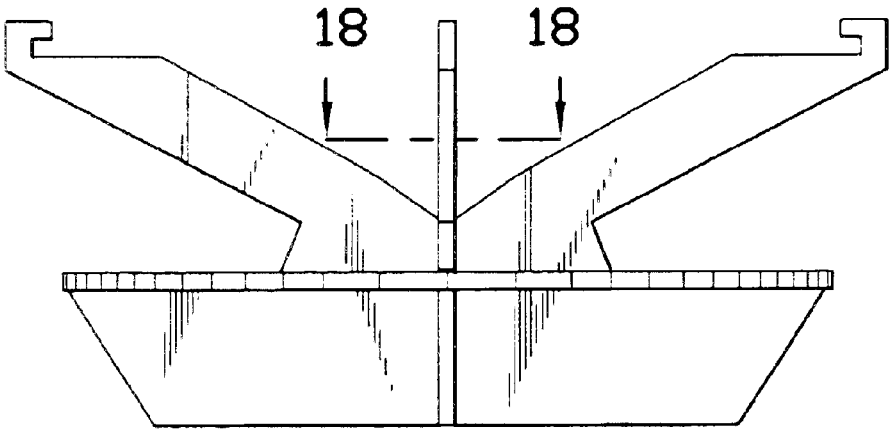
FIG. 17 is an enlarged, partially assembled/disassembled, front plan view of the alternative embodiment.
Figure 19:
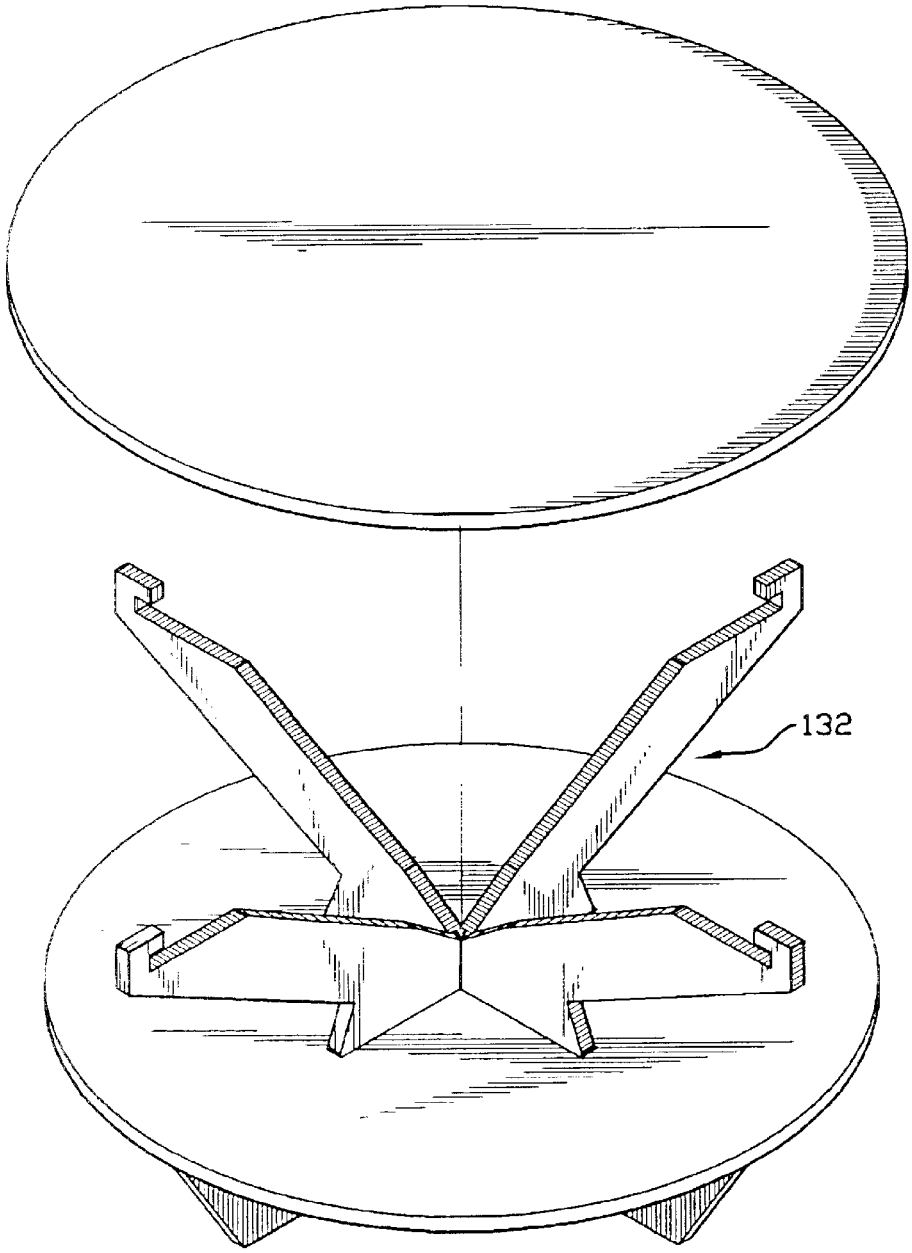
FIG. 19 is an enlarged, partially exploded, isometeric view of the alternative embodiment in a partially assembled/disassembled orientation.
Figure 20:
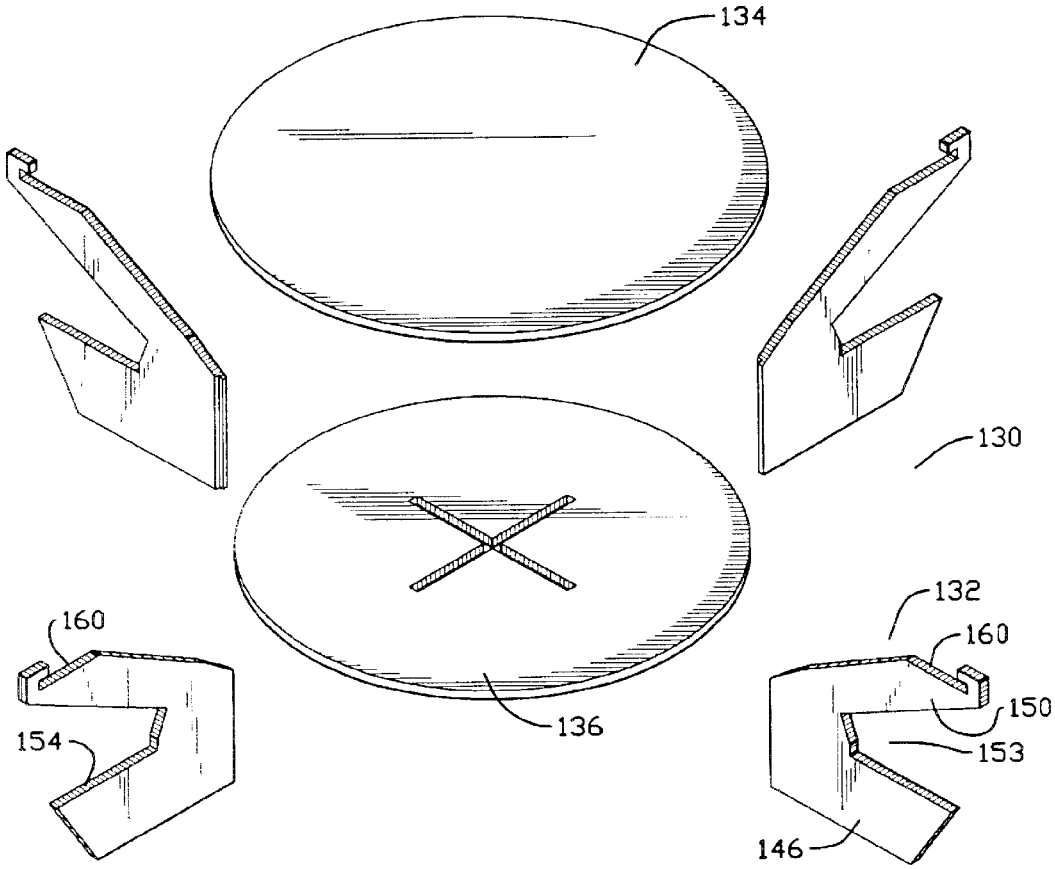
FIG. 20 is a fully exploded, isometeric view of the alternative embodiment.

Proper dimensioning of the legs and the lock slots is important. As best seen in FIGS. 11 and 12, the leg midsection's inner edges 54 are preferably stepped, comprising a notch 90 and a projection 91. When the legs are compressed together in the assembled shape, the notch of one leg abuts the notch of the others, forming the arrangement of FIG. 12. However, the inner edges of the legs could be designed differently. For example, each could be shaped like a pointed arrow. Importantly, the critical fitting distance between one leg projection 91 (FIG. 12) and the outer end 83 of a corresponding slot has been designated by reference numeral 85 (FIG. 12). This distance 85 is preferably equal to the width between inner edge 54 and ramp 69.

The legs are thus bound together in frictional, compressive abutting relation as in FIG. 12, by compressive action of the lock 36 as it is pressed down over the legs during assembly. The variable width midsection region (i.e., the leg width between ramps 67, and edge 54) is captivated within lock slots of finite length; as the lock is pressed downwardly, with the legs properly oriented, action of the ramps 67, 69 sliding against the outermost limits of the lock slots results in compression. The legs are compressed slightly, as they are firmly drawn together by the lock. At the same time, the inner edges 54 of each leg mutually abut one another (FIG. 12). The various projections 91 (FIG. 12) abut in the mutually facing notches 90 to form a stable, radially interlocking structure. The compressed legs will remain stable in this radially interlocking arrangement, with predetermined compressive forces from the properly mounted lock 36 maintaining all the parts together.

Assembly

Figure 6:
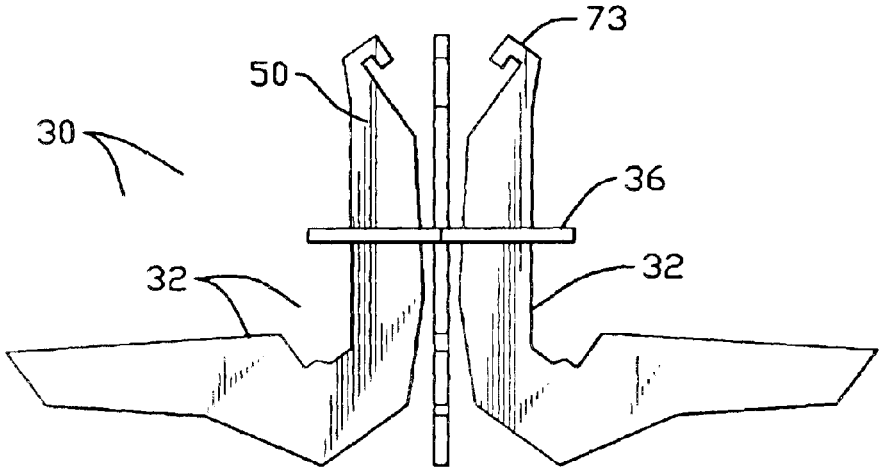
FIG. 6 is a front elevational view of the partially erected assembly of FIG. 5, with the legs in a position after initial assembly.
Figure 8:
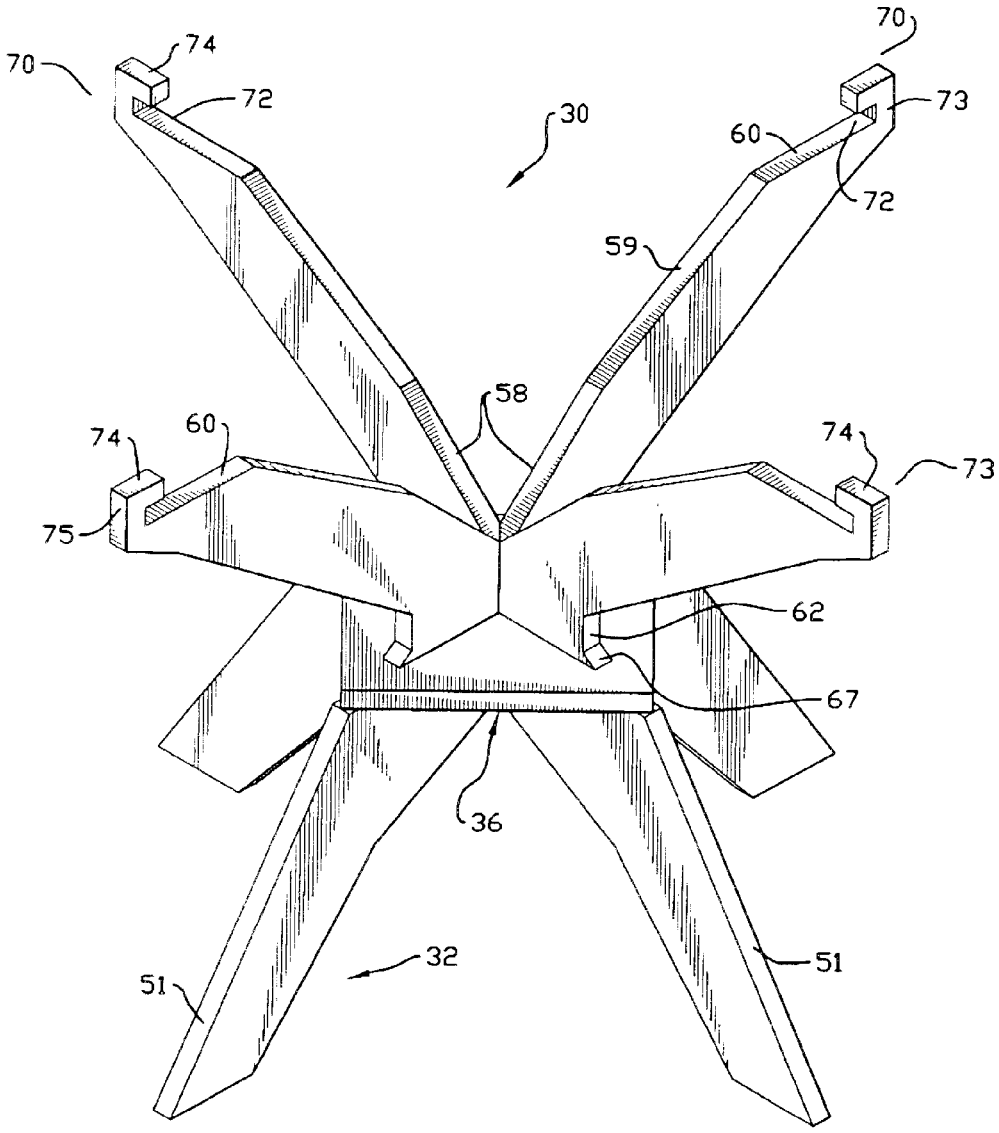
FIG. 8 is a frontal isometeric view of the table, with the legs fully inserted and rotated into a potential top-grasping configuration before reaching the final assembled orientation.

Referring to FIG. 9, the flat pieces should be recognized, and laid out in a flat, symmetrical arrangement prior to assembly. A prudent assembler will be cognizant of the preferred, target configuration seen in FIG. 1. As seen in FIG. 6, the arms 50 of each leg are first thrust into the various slots 80 of the planar lock 36, and preferably, their generally radially spaced-apart target orientation is preserved. As the legs reach upwardly and are positioned vertically, their hooks 70 may engage the tabletop 34. As the pertinent tabletop edges 40 are firmly received within the channels 72 (FIG. 10), alignment begins. The width of the leg's midsection between wedging region 53 (i.e., ramp edge 67, 69) and inner edge 54 increases from top to bottom. The legs may first be arranged in a generally radially spaced apart, vertical orientation as in FIG. 4. Then the lock 36 is "installed." Essentially, the legs are first thrust within the lock slots 80 and then rotated about their midsections to transform them between the orientations depicted in FIGS. 5 and 10. Once the legs are rotated to assume the desired orientation wherein they grasp top 34, the lock 36 may be gently pressed downwardly, until resting upon ledges 52 (FIG. 5) and forming the stable assembly. This locks or "wedges" the parts into position with its slot ends 83 (FIG. 9) being wedged against the ramping surfaces 69 (FIG. 5) defined in the leg midsections. Once the lock 36 is pressed downwardly until it firmly rests upon the previously described leg ledges 52 (FIG. 4), assembly is completed, and the arrangement will remain stable and fixed.

Alternative Embodiment

An alternative embodiment (i.e., the second embodiment), seen in FIGS. 13–21 of the drawings, comprises a chair 130. Alternatively, it can be used as a stool, a table, or a shelf Chair 130 (FIGS. 20, 21) comprises a plurality of legs 132, a preferably circular top 134, and a preferably circular lock 136. In this embodiment, the lock is sized and configured somewhat like the top 134. As before, when the aforementioned planar parts are correctly assembled, a strong and dependable structure results.

Each leg 132 (FIG. 20) is identical. With primary reference directed to FIGS. 16, 20, and 21, the legs comprise a bottom foot 146, an upper arm 150, and an integral midsection 148. As before, a step-like, stair-shaped wedging region 153 (FIG. 21) is formed in the midsection at the angular vertice formed by foot 146 and arm 150. Each arm 150 integrally extends angularly upwardly and outwardly from each corresponding midsection 148. An upper supporting ledge 160 supports the top 134 after assembly. The lower ledge 154 supports the lock 136 in the same manner as that previously described.

Figure 21:
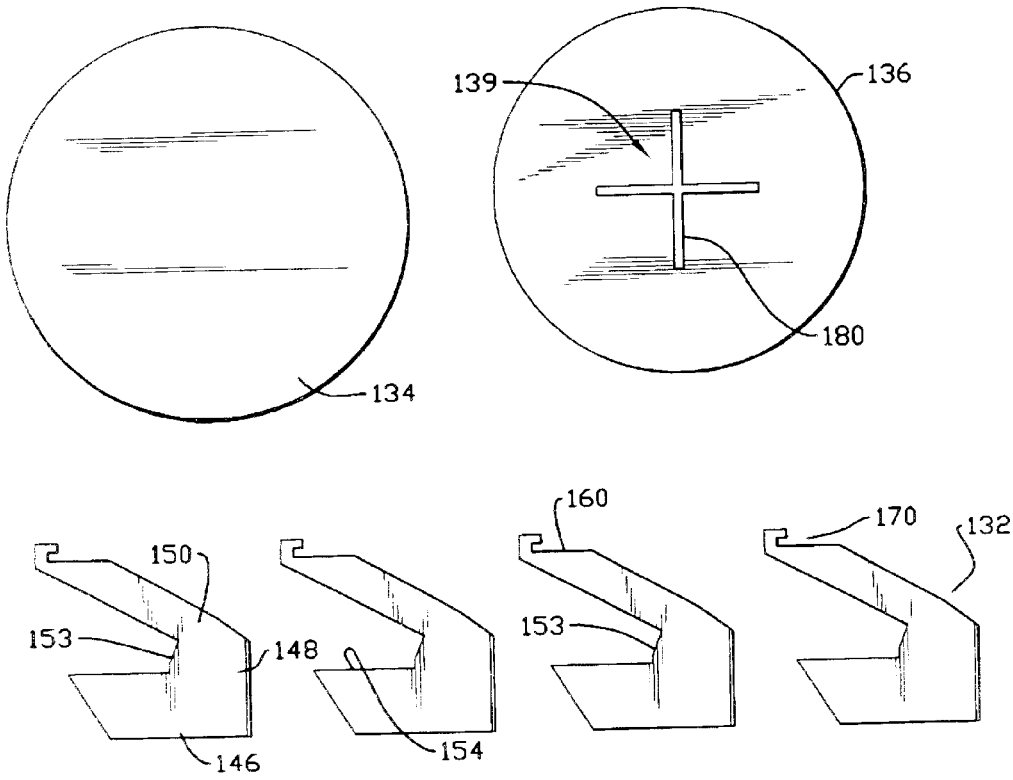
FIG. 21 is an exploded plan view of the individual, unassembled parts of the alternative embodiment conveniently with the components flatly disposed in a position for transportation or assembly.

As best seen in FIG. 21, the leg midsections all comprise a wedging region 153 having a pair of angled ramp portions that function, as described previously, when the legs are compressed within the lock's slot structure 139. As before, each leg 132 terminates at its top in a generally C-shaped hook 170 that captivates the top 134 upon assembly. The lock's slot structure 139, is symmetrical, in the form of a cross, and comprises four individual radially spaced apart slots 180 (FIG. 21) to fit the four legs. These slots are dimensioned carefully to frictionally and firmly receive and lock the legs as previously described. Assembly also occurs as previously described.

Preferred Embodiment

A preferred embodiment is seen in FIGS. 22–26 of the drawings. A furniture item 200, nominally shaped like a table, can also be used as a stool or shelf Item 200 comprises a plurality of similar, flat legs 202, a preferably circular top 204, and a preferably circular lock 206 that has a smaller diameter than tabletop 204. Of course, top 204 and lock 206 can be shaped or dimensioned differently, as will be appreciated by those skilled in the art. In this embodiment, the lock is also sized and configured somewhat like the top 204. Once again, when the aforementioned planar parts are correctly assembled, a strong and dependable structure results. However, the lock 206 is coupled to the legs through a different arrangement. While the indicated structure is slightly different, principles of operation remain largely the same.

Each identical leg 202 comprises a bottom foot 208, an upper arm 210, and a locking protrusion 212 (i.e., FIG. 22), all of which integrally emanate from junction region 209. A locking recess 211 is formed within protrusion region 209 above the juncture of arm 210 and protrusion 212. As with the prior embodiments, each leg 202 terminates at its top in a generally C-shaped hook 221 (FIG. 26) that captivates the top 204 upon assembly. Unlike prior embodiments, lock 206 is not penetrated by the arms of the legs; rather, it is fitted to the abutting protrusions 212. Each protrusion 212 defines a step-like, stair-shaped wedging region 215 that tightly fits through slot structure 218 defined in lock 206. Each arm 210 integrally extends angularly upwardly and outwardly from the corresponding protrusion 212. An upper supporting ledge 220 on each arm 210 jointly supports the tabletop 204 after assembly. Each locking recess 211 has a lower ledge 230. Upon assembly, the aligned ledges 230 provide a seat that supports the lock 206 after it is forcibly pressed into place.

Figure 26:
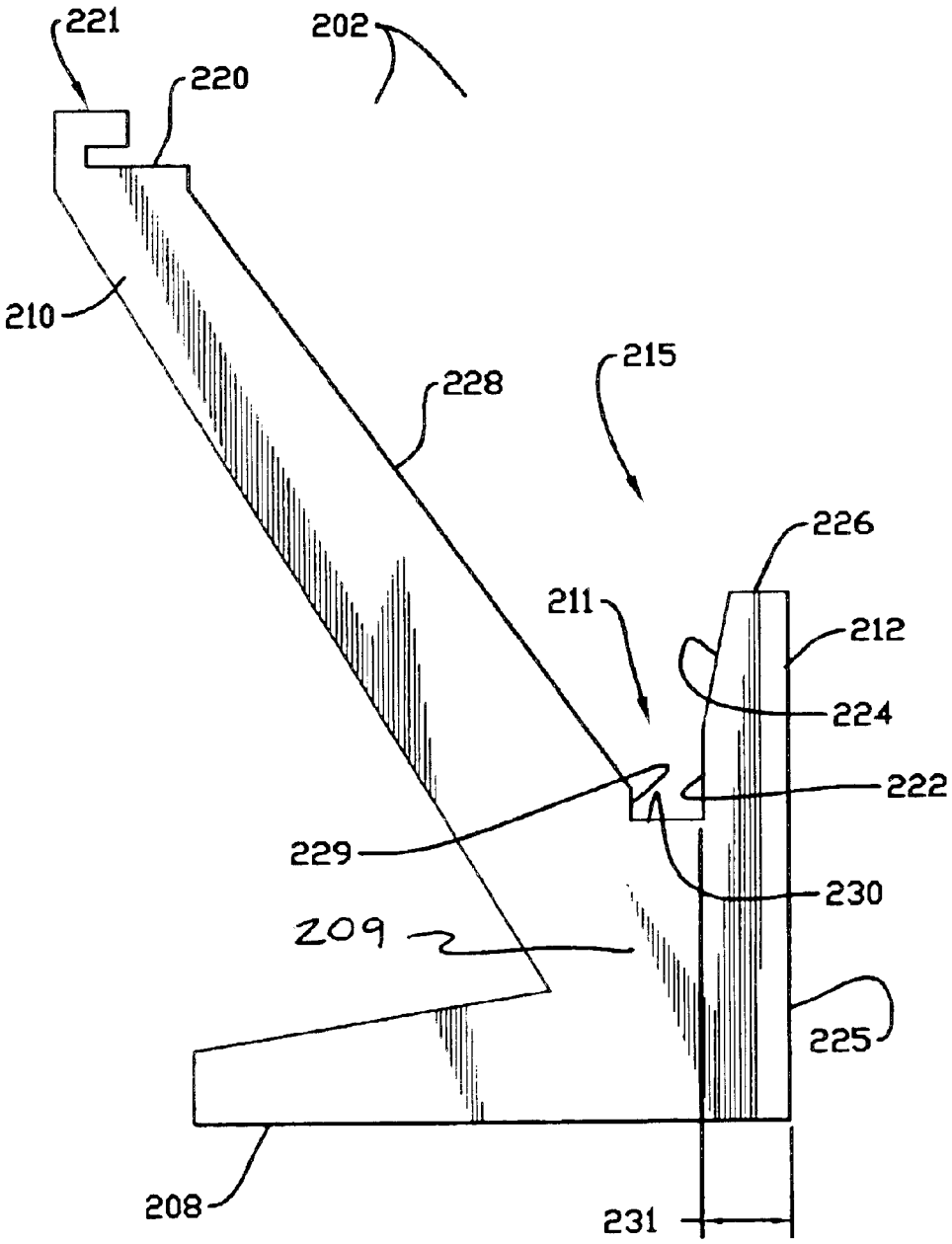
FIG. 26 is a greatly enlarged plan view of a leg used in it the embodiment of FIGS. 22–25.

As best seen in FIG. 26, the wedging region 215 comprises a straight, perpendicularly upwardly extending edge 222 defined on protrusion 212 that is spaced apart from and parallel with the legs' elongated inner edge 225. Inner edge 222 adjoins the upwardly extending, inclined protrusion edge 224 that functions as a ramp. Edge 224 extends upwardly to the flat protrusion top 226. The protrusions 212 (i.e., FIG. 26) get narrower towards their tops 226. The spaced-apart arm 210 has an inclined upper edge 228 that extends angularly upwardly from the arms' lower vertical edge portion 229 (FIG. 26). The arms' vertical edge portion 229 is spaced apart from and parallel with protrusion edge 222, with a flat, lower ledge 230 defined therebetween.

Figure 22:
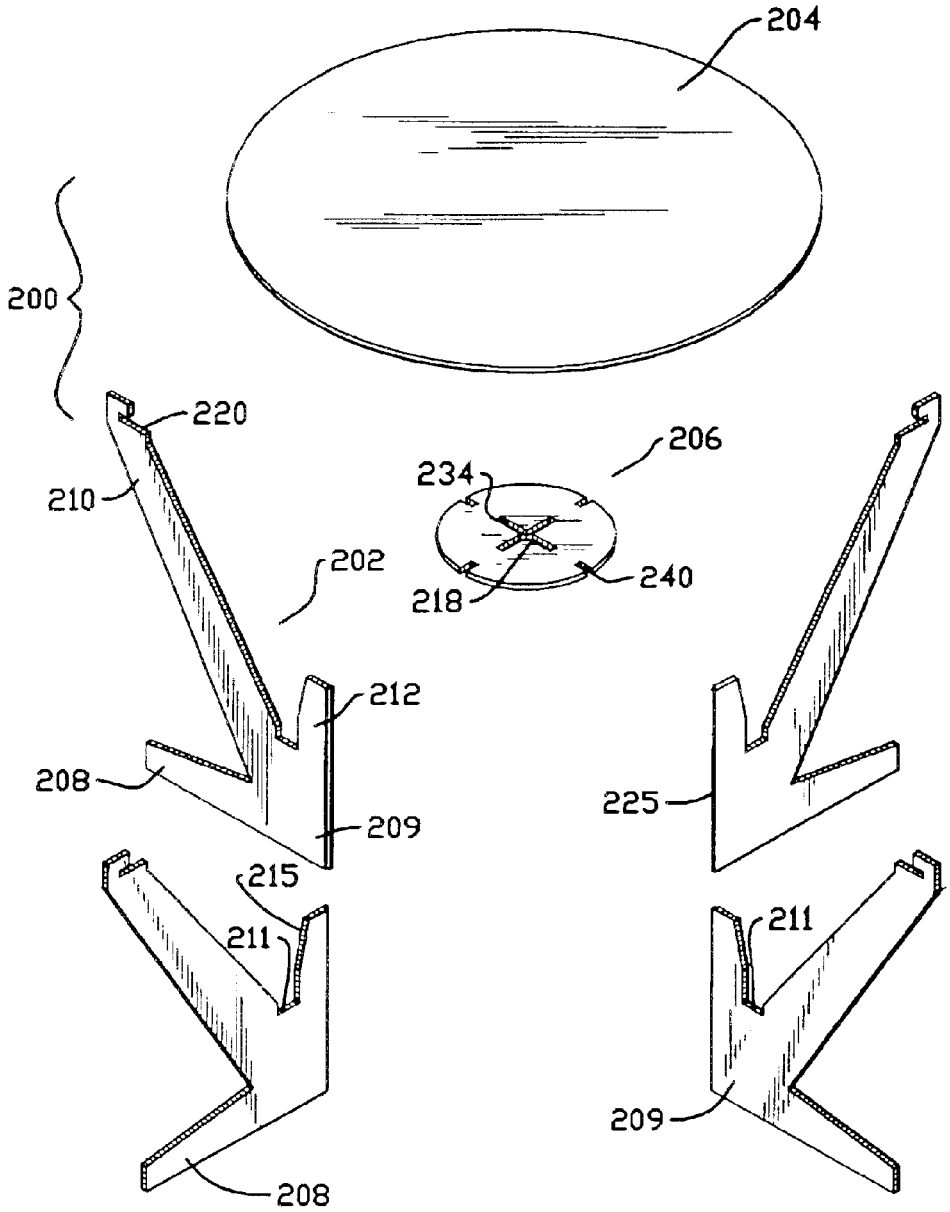
FIG. 22 is a frontal isometric view of an embodiment of my invention, in which the lock is not penetrated by the leg's arms.
Figure 24:
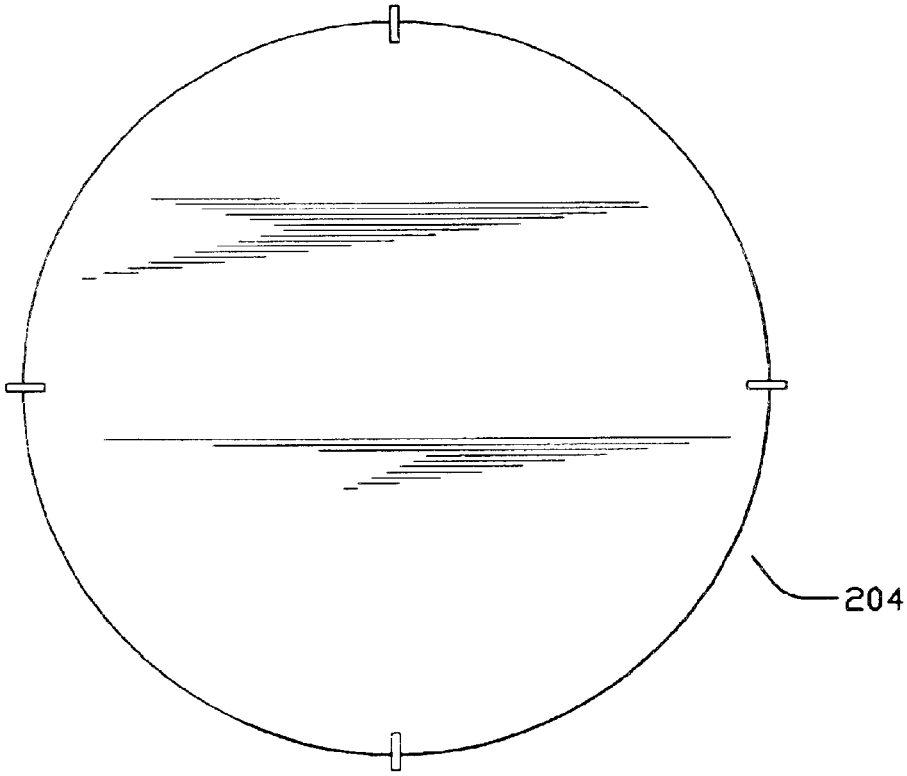
FIG. 24 is a top plan view.
Figure 23:
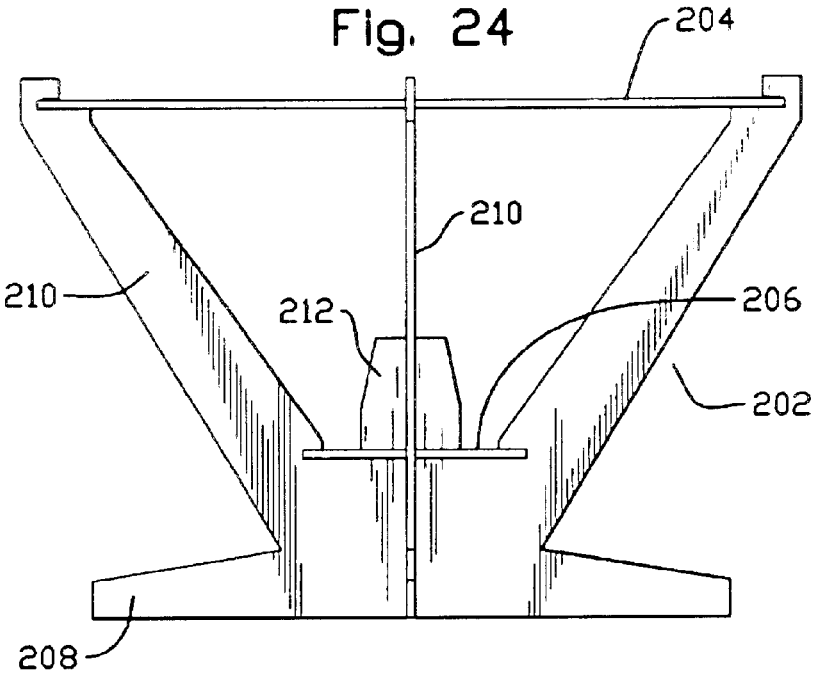
FIG. 23 is a front plan view of the embodiment of FIG. 22.
Figure 25:
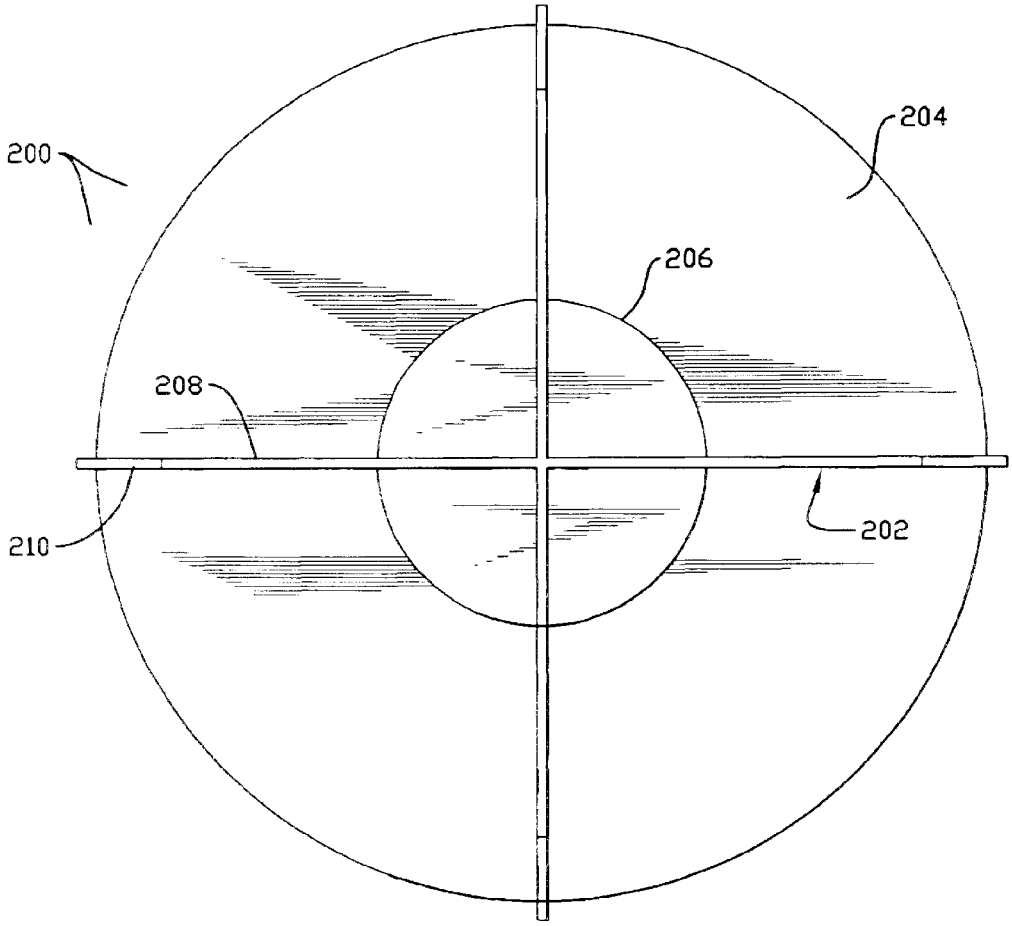
FIG. 25 is a bottom plan view.

The lock's slot structure 218 (FIG. 22) is symmetrical, preferably in the form of a cross, for embodiments using four legs. There are four individual, radially spaced apart slots 234 (FIG. 22) to fit the four legs. These slots are dimensioned carefully to frictionally and firmly receive and lock the legs as previously described. They are dimensioned substantially the same as dimension 231 in FIG. 26 so that firm locking engagement occurs when the lock is press fitted downwardly over the abutting protrusions on the radially-aligned leg structures. When pressed downwardly, the slot structure edges 224 first penetrate slot structure 218, and as pressure continues, the lock is frictionally snap-fitted in firm compressive engagement between aligned, coplanar legs whose protrusions 212 occupy the lock slots. The lock comes to rest upon lower ledge 230 within recess 211 (FIG. 26). Additionally, each lock 206 comprises radially spaced apart, peripheral notches 240 that are aligned with individual slots 234 (FIG. 22). In assembly, the lock notches 240 firmly receive and abut arm edges 229 (FIG. 26) previously described, to create further frictional locking forces upon assembly. The solid body region of the locks between the peripheral notches 240 and the slots 218 is wedged into recess 211, overcoming predetermined yieldable forces from gradual tightening as the apparatus rides over incline 224 during assembly. When pressed far enough into engagement, the lock rests upon the ledge 230 provided by each leg.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof; it is to be understood that all matter herein set forth or shown in the accompanying drawings is to be interpreted as illustrative and not in a limiting sense.

What is claimed is:

1. A modular, knockdown furniture item adapted to be disposed upon a generally flat or horizontal supporting surface, the furniture item comprising:

a generally planar top adapted to be supported vertically above said supporting surface;

a plurality of generally planar, radially spaced apart legs, each leg comprising:

a junction region;

an integral, lower foot extending generally horizontally away from said junction region for contacting said supporting surface;

an integral, upper arm extending angularly outwardly and upwardly from said junction region, the arm comprising upper hooks for grasping said top and ledges for supporting said top in a flat orientation, an integral, upright protrusion extending vertically upwardly away from said junction region, the protrusion comprising a top, an elongated, inner edge adapted to contact the similar elongated edge of an adjoining leg protrusion upon assembly, and an inclined edge forming a ramp opposite said inner edge;

a locking recess disposed between each arm and protrusion, the locking recess comprising a flat lower ledge;

wherein each arm comprises a lower vertical edge portion adjacent said locking recess that is generally perpendicular to said flat lower ledge, and each protrusion comprises a lower, straight edge formed beneath said ramp that is generally perpendicular to said flat lower ledge and spaced apart from and parallel with said arm lower vertical edge portion;

a lock adapted to be substantially horizontally deployed above said surface and beneath and parallel to said top for captivating the legs and compressing them together in fixed, radially spaced-apart alignment, the lock comprising a periphery surrounding intersecting, internal slots that are penetrated by the protrusions when the lock is press fitted into engagement into the locking recess, the lock comprising planar portions flatly resting upon the lower ledge portions of said locking recesses; and, wherein when the lock seats against and within said locking recesses, the legs are compressively captivated together in fixed, radially spaced apart alignment with said protrusion elongated inner edges being compressively locked together in mutually abutting relation, said hooks are drawn inwardly into engagement with said top, and the periphery of said lock abuts the lower vertical edge portions of said arms.

2. A modular, knockdown table adapted to be disposed upon a generally flat or horizontal supporting surface, the table comprising:

a plurality of generally planar, radially spaced apart legs that support the table, each leg comprising:

a junction region;

an integral, lower foot extending generally horizontally away from said junction region for contacting said supporting surface;

an integral, upper arm extending angularly outwardly and upwardly from said junction region, the arm comprising upper hooks adjacent upper ledges;

an integral, upright protrusion extending vertically upwardly away from said junction region, the protrusion comprising a top, an elongated, inner edge adapted to contact the similar elongated edge of an adjoining leg protrusion upon assembly, and an inclined edge forming a ramp opposite said inner edge;

a locking recess disposed between each arm and protrusion, the locking recess comprising a flat lower ledge;

wherein each arm comprises a lower vertical edge portion adjacent said locking recess that is generally perpendicular to said flat lower ledge, and each protrusion comprises a lower straight edge formed beneath said ramp that is generally perpendicular to said flat lower ledge and spaced apart from and parallel with said arm lower vertical edge portion;

a generally planar top adapted to be supported vertically above said supporting surface upon said upper ledges of said arms, and grasped by said hooks;

a lock adapted to be substantially horizontally deployed above said surface and beneath and parallel to said top for captivating the legs and compressing them together in fixed, radially spaced-apart alignment, the lock comprising a periphery surrounding intersecting, internal slots that are penetrated by the protrusions when the lock is press fitted into engagement into the locking recess, the lock comprising planar portions flatly resting upon the lower ledge portions of said locking recesses; and, wherein the lock seats against and within said locking recesses, the legs are compressively captivated together in fixed, radially spaced apart alignment with said protrusion elongated inner edges being compressively locked together in mutually abutting relation, said hooks are drawn into engagement with said top, and the periphery of said lock abuts the lower vertical edge portions of said arms.

* * * * *